US007187258B2

(12) United States Patent
Yamazaki et al.

(10) Patent No.: US 7,187,258 B2
(45) Date of Patent: Mar. 6, 2007

(54) CIRCUIT BREAKER

(75) Inventors: Tomoo Yamazaki, Saitama (JP); Mitsuhiro Mitsushige, Saitama (JP); Koji Asakawa, Saitama (JP); Hideto Yamagata, Saitama (JP); Akifumi Sato, Saitama (JP)

(73) Assignee: Fuji Electric FA Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 11/146,005

(22) Filed: Jun. 7, 2005

(65) Prior Publication Data

US 2005/0275493 A1 Dec. 15, 2005

(30) Foreign Application Priority Data

Jun. 10, 2004 (JP) ..... 2004-172585

(51) Int. Cl.
*H01H 9/30* (2006.01)

(52) U.S. Cl. ..... 335/201; 200/305

(58) Field of Classification Search ..... 335/16, 335/147, 195, 201; 218/22, 48, 50, 146–7; 200/244, 305

See application file for complete search history.

(56) References Cited

U.S. PATENT DOCUMENTS 4,451,718 A * 5/1984 Yamagata et al. ..... 218/23
4,539,538 A * 9/1985 Flick et al. ..... 335/16
4,540,961 A * 9/1985 Maier ..... 335/16
4,654,490 A * 3/1987 Leone et al. ..... 218/33
4,716,265 A 12/1987 Fujii et al.
4,916,420 A * 4/1990 Bartolo et al. ..... 335/172
5,206,614 A * 4/1993 Carothers ..... 335/16
5,723,841 A 3/1998 Kurono
5,899,323 A 5/1999 Rakus
6,300,586 B1 * 10/2001 Doughty et al. ..... 218/148

FOREIGN PATENT DOCUMENTS

| | | |
|---|---|---|
| DE | 203 12 624 | 1/2005 |
| JP | S57-130329 | 8/1982 |
| JP | S547-130325 | 8/1982 |

* cited by examiner

*Primary Examiner*—Elvin Enad
*Assistant Examiner*—Bernard Rojas
(74) *Attorney, Agent, or Firm*—Manabu Kanesaka

(57) ABSTRACT

A circuit breaker includes an elongated movable contact having a contact at one end thereof for flowing a current therethrough and the other end rotatably supported with a holder, and a protection cover made of an insulating material for covering and protecting a movable contact from short circuit and discharge. The protection cover is made of only the insulating material, covers the movable contact, and has elasticity to tightly hold the movable contact.

7 Claims, 3 Drawing Sheets

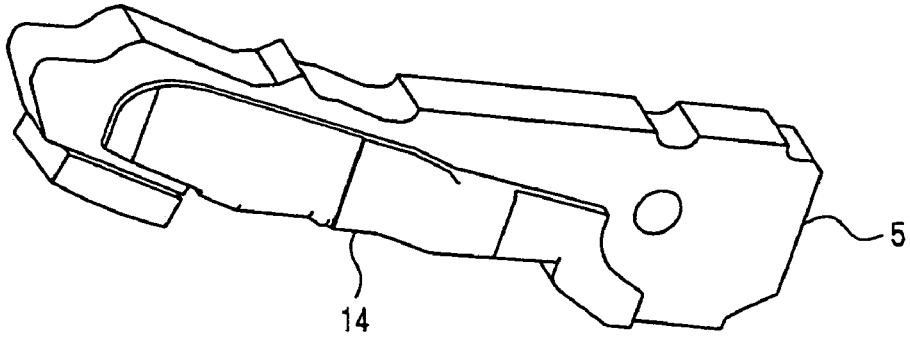
Fig. 4
Fig. 5(a)
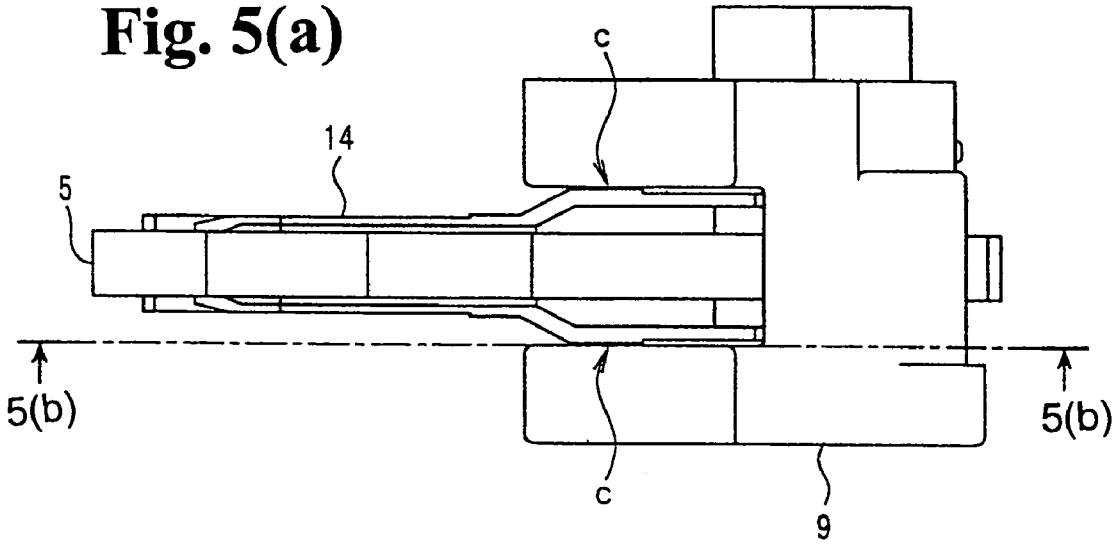
Fig. 5(b)
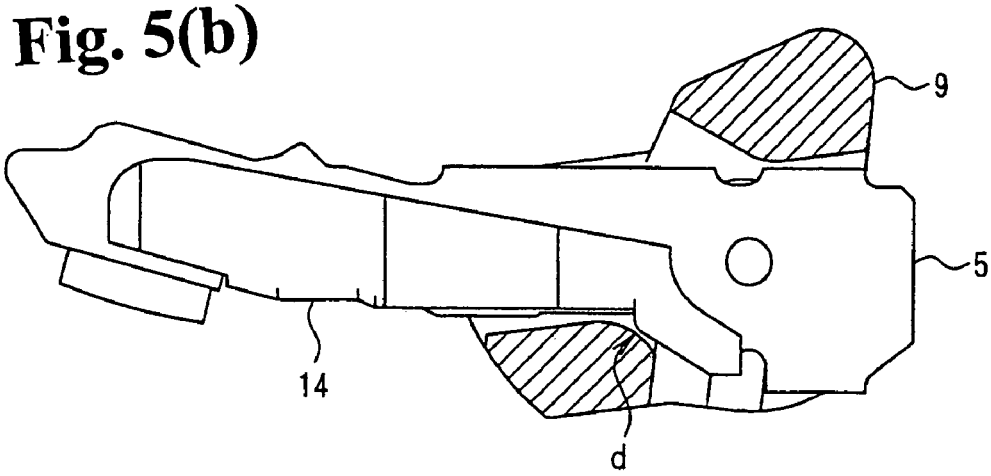

CIRCUIT BREAKER

BACKGROUND OF THE INVENTION AND RELATED ART STATEMENT

The present invention relate to a circuit breaker such as a molded case circuit breaker or an earth leakage breaker having a movable contact opened by an electromagnetic repulsive force when a large current such as a short-circuit current flows. In particular, the present invention relates to a circuit breaker having a protection cover made of an insulating material that covers a movable contact to extinguish a contact arc generated when the contact opens.

A protection cover made of an insulating material for a movable contact in a conventional circuit breaker is disclosed in Patent Reference 1 or 2. According to Patent References 1 and 2, the insulating material is disposed near a contact of the movable contact to improve breaking capability. The insulating material having a shape to cover a periphery of the contact is fixed by clamping with a pin penetrating the contact and the insulating material.

Patent Reference 1: Japanese Patent Publication (Kokai) No. 57-130325

Patent Reference 2: Japanese Patent Publication (Kokai) No. 57-130329

In the circuit breakers disclosed in Patent References 1 and 2, when the protection cover made of the insulating material is disposed to cover the movable contact, the protection cover is pressed against the movable contact by clamping with the pin (or clamping with a bolt). Depending on the material and strength of the protection cover and the pin, the protection cover may break when the pin is clamped with an excessive stress. When the protection cover is loosely fixed and the protection cover is detached as the moving contact repeats opening and closing, the contact arc can not be extinguished upon an over-current, thereby damaging a wiring on a secondary side of the circuit breaker and a connection device.

Also, the arc may be spread through a metal member such as a pin and the like, thereby lowering current limiting capability. When the protection cover is damaged, the protection cover may fall off and obstruct a function of the circuit breaker, thereby damaging a wiring on a secondary side of the circuit breaker.

In view of the foregoing problems, an object of the present invention is to provide a circuit breaker in which a protection cover made of an insulating material covers a movable contact and is difficult to detach without other components causing an adverse effect such as spreading an arc, thereby preventing damage on a wiring on a secondary side of the circuit breaker and a connection device.

Further objects and advantages of the invention will be apparent from the following description of the invention.

SUMMARY OF THE INVENTION

To achieve the foregoing objects, according to a first aspect of the present invention, a circuit breaker includes an elongate plate-shaped movable contact having a contact at one end thereof for flowing a current therethrough and the other end rotatably supported with a holder, and a protection cover made of an insulating material for covering and protecting a movable contact from short circuit and discharge. The protection cover has a shape made of only the insulating material to cover the movable contact and elasticity to tightly hold the movable contact.

With this structure, the protection cover is formed of the insulating material only and incorporated in the movable contact without a metal member such as a pin as in a conventional breaker. Therefore, it is possible to eliminate a step of clamping a pin in the conventional breaker, thereby reducing manufacturing cost. The protection cover is incorporated in the movable contact without a metal member, thereby preventing an arc from spreading due to a metal material as in the conventional breaker and improving current limiting capability.

According to a second aspect of the present invention, in the circuit breaker in the first aspect, the movable contact may be provided with a through-hole penetrating through two lateral sides thereof or recess portions in the two lateral sides. Further, the protection cover may be provided with a protrusion for inserting in the through-hole or the recess portions.

With this structure, when the protection cover is incorporated in the movable contact, the protrusion is fitted into the through-hole or the recess portions, so that the protection cover does not shift from the movable contact and is held tightly.

According to a third aspect of the present invention, in the circuit breaker in one of the first and second aspects, the movable contact may be provided with a protrusion, and the protection cover may be provided with a recess portion for receiving the protrusion on the movable contact.

With this structure, when the protection cover is incorporated in the movable contact, the protrusion on the movable contact is fitted in the recess portion in the protection cover, so that the protection cover does not shift from the movable contact and is held tightly. When the third aspect is combined with the second aspect, the protrusions are fitted in the recess portions at separate positions, so that the protection cover is held tightly.

According to a fourth aspect of the present invention, in the circuit breaker in one of the first to third aspects, the protection cover has a shape such that a periphery thereof is supported by a holder when the protection cover is incorporated in the movable contact.

With this structure, the periphery of the protection cover corresponding to a holder arrangement part is supported by the holder. Therefore, even if the recess portions and protrusions are broken, the protection cover is not detached when the movable contact is opened and closed.

As described above, according to the present invention, the protection cover made of the insulating material covers the movable contact and is difficult to detach without other components causing an adverse effect such as spreading an arc, thereby preventing damage on a wiring on a secondary side of the circuit breaker and a connection device.

BRIEF DESCRIPTION OF THE DRAWINGS

FIG. 4 is a view showing a state where the protection cover is incorporated in the movable contact of the circuit breaker according to the embodiment; and FIGS. 5(*a*) and 5(*b*) are views showing a state where the movable contact incorporated in the protection cover of the circuit breaker is incorporated in a holder according to the embodiment, wherein FIG. 5(*a*) is a plan view thereof, and FIG. 5(*b*) is a sectional view taken along line 5(*b*)—5(*b*) in FIG. 5(*a*).

DETAILED DESCRIPTION OF PREFERRED EMBODIMENTS

Hereinafter, embodiments of the present invention will be described with reference to the accompanying drawings.

Figure 1:
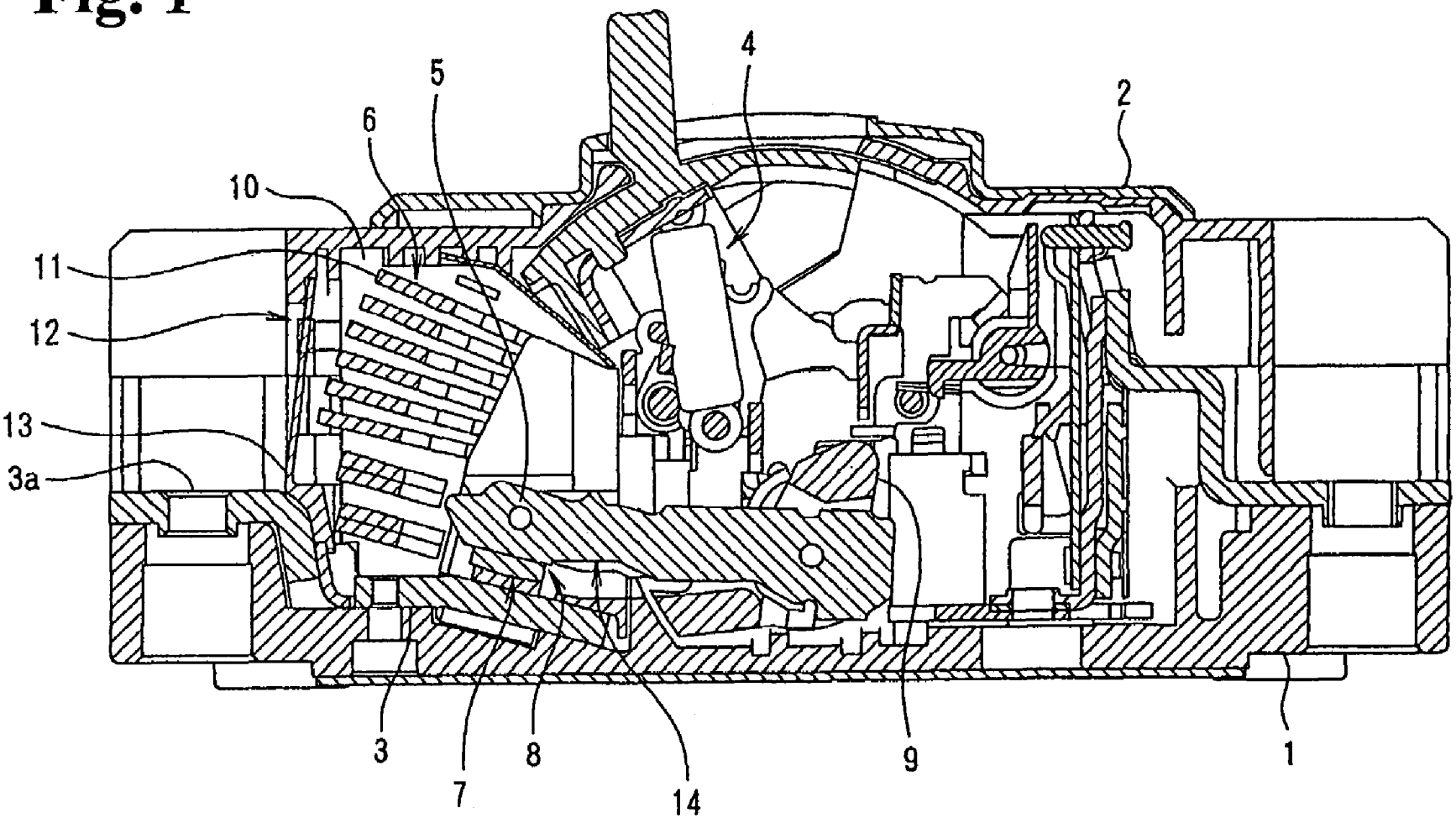
FIG. 1 is a longitudinal sectional view showing essential parts at a central pole section of a three-pole circuit breaker according to an embodiment of the present invention.

FIG. 1 is a longitudinal sectional view showing essential parts at a central pole section of a three-pole circuit breaker according to an embodiment of the present invention. In the circuit breaker shown in FIG. 1, a breaking unit is disposed in an insulating container formed of a case 1 and a cover 2, and includes a fixed contact 3 fixed to the case 1 and an elongate plate-shaped movable contact 5 driven to open and close by an opening/closing mechanism 4. An arc extinguish chamber 6 is installed in the breaking unit.

FIG. 1 shows the breaking unit at the central pole section, and the insulating container is divided into three-phase spaces by phase partitions and a breaking unit corresponding to each phase is housed in each space. The fixed contact 3 has a power-side terminal 3*a* integrally formed at one end and a fixed contact 7 at the other end.

The movable contact 5 having a movable contact 8 that moves in contact with and away from the fixed contact 7 is rotatably supported on the case 1 via a holder 9 made of an insulating material, and is driven to open and close by the opening/closing mechanism 4, using an opening/closing axis (not shown) integrated with the holder 9 as a support point. The arc extinguish chamber 6 has a structure such that plural grids 11 made of a magnetic material are vertically stacked and supported at proper intervals on a pair of left and right sidewalls (supporting member sidewalls) 10 of a supporting member made of an insulating material. The grid 11 has a U-shape provided with a cut-out to pass the movable contact 5 when the movable contact 5 is driven.

An arc gas emission port 12 is provided ahead of the breaking unit. The arc gas emission port 12 is closed by a protection board 13 made of an insulating material to prevent entry of foreign matter. The protection board 13 is fixed by having both sides of its base part inserted between the supporting member sidewall 10 and the fixed contact 3. Meanwhile, a protection cover 14 made of a molded insulating material to cover the movable contact 5 is provided between the breaking unit and the opening/closing mechanism 4.

Arc gas generated at the time of breaking contains molten metals generated from the contacts 7 and 8, the fixed contact 3, the movable contact 5, the grids 11, and the like. However, the partitions interrupt the movement of the arc gas to the opening/closing mechanism 4 and thus prevent the molten metals contained in the arc gas from being scattered and attached to the opening/closing mechanism 4 and its peripheral part.

In the embodiment, the circuit breaker having the structure as described above is characterized by the structure of the protection cover 14 made of an insulating material covering the movable contact 5 and the structure of the movable contact 5 for attaching the protection cover 14.

Figure 2A:
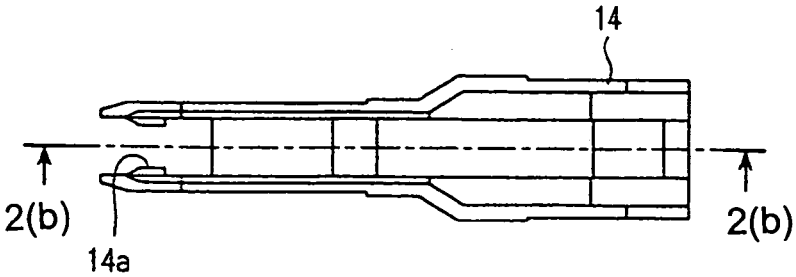
FIGS. 2(*a*) and 2(*b*) are views showing a structure of a protection cover of the circuit breaker according to the embodiment, wherein FIG. 2(*a*) is a plan view showing the structure of the protection cover, and FIG. 2(*b*) is a sectional view of the protection cover taken along line 2(*b*)—2(*b*) in FIG. 2(*a*)
Figure 2B:
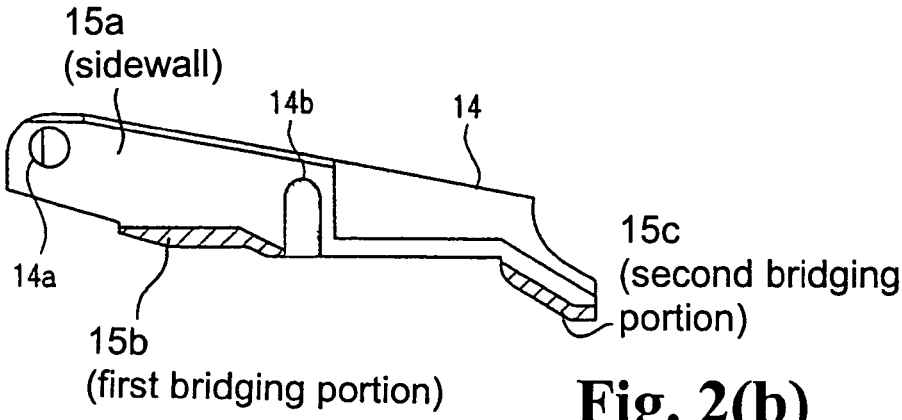

FIG. 2(*a*) is a plan view showing the structure of the protection cover 14. FIG. 2(*b*) is a sectional view showing a section of the protection cover 14 taken along line 2(*b*)—2(*b*) in FIG. 2(*a*). As shown in FIG. 2, the protection cover 14 has an elongate U-shape to hold both lateral sides of the movable contact 5 from the lower side and thus cover the movable contact 5, so that the contact of the elongate plate-shaped movable contact 5 having a predetermined width is exposed. On the parallel inner sidewalls near the distal end of this U-shape, protrusions 14*a* are provided. On the outer sidewall corresponding to the intermediate part of the movable contact 5, a recess portion 14*b* is provided. The width between the parallel sidewalls from the vicinity of the part where the recess portion 14*b* is provided to the proximal end is broader than the width on the distal end side. The sidewall parts having the broader width between them are to be fitted with the parallel inner walls of the holder 9 (described later). The elongate U-shaped protection cover 14 is made of a thermoplastic insulating material such as plastics and has elasticity to tightly hold the movable contact 5 from below and maintain this state by itself.

Namely, the protection cover 14 is formed by two sidewalls 15*a* with the protrusions 14*a* and one recess portion 14*b*, and first and second bridging portions 15*b*, 15*c* for connecting the side walls 15*a*. The first and second bridging portions 15*b*, 15*c* are spaced apart from each other.

Figure 3A:
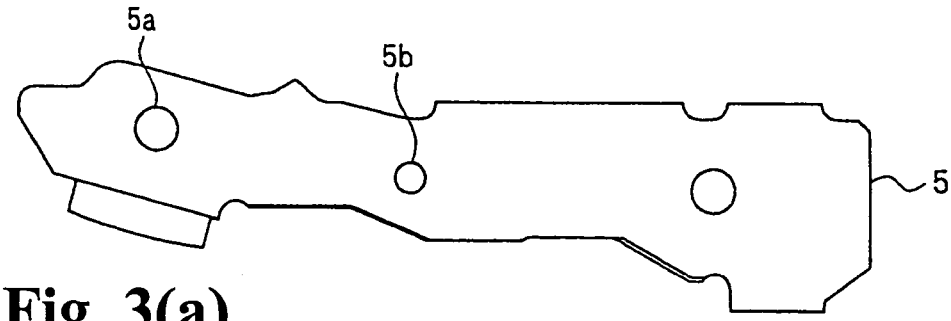
FIGS. 3(*a*) and 3(*b*) are views showing the structure of the protection cover of the circuit breaker according to the embodiment, wherein FIG. 3(*a*) is a side view showing a movable contact, and FIG. 3(*b*) is a plan view thereof.
Figure 3B:
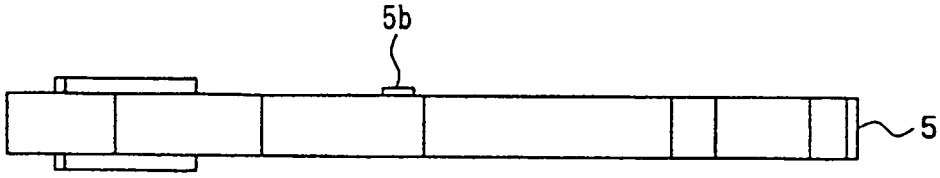

FIG. 3(*a*) is a side view schematically showing the movable contact 5. FIG. 3(*b*) is a plan view thereof. As shown in FIG. 3(*a*), the movable contact 5 has an elongate plate-shape with a predetermined width. Near its distal end where the contact is provided, a through-hole 5*a* is provided to fit with the protrusions 14*a* of the protection cover 14. On the outer sidewall in the intermediate part between the distal end and the proximal end, a protrusion 5*b* is provided to fit in the recess portion 14*b* of the protection cover 14. Instead of the through-hole 5*a*, recesses in which the protrusions 14*a* can fit may be provided on both lateral sides of the movable contact 5.

FIG. 4 shows a state where the protection cover 14 is incorporated with the movable contact 5 having the above-described structure. In the case of such incorporation, the protection cover 14 is fitted with the movable contact 5 from below, with both lateral sides of the movable contact 5 being held between the sidewalls of the protection cover 14. The protrusions 14*a* are fitted into the through-hole 5*a* and the recess portion 14*b* is fitted with the protrusion 5*b*. Since the fitting is made in this manner at the separate positions on the lateral sides, the protection cover 14 is prevented from shifting vertically or horizontally from the movable contact 5. Moreover, since the bottom side of the protection cover 14 abuts against the lower side of the movable contact 5, the protection cover 14 does not shift upwardly.

The protection cover 14 is also fitted in the holder 9, which rotatably supports the movable contact 5 on the case 1, as shown in FIGS. 5(*a*) and 5(*b*). FIG. 5(*a*) is a plan view showing a state where the movable contact 5 incorporated with the protection cover 14 is incorporated in the holder 9. FIG. 5(*b*) is a sectional view showing a section taken along line 5(*b*)—5(*b*) in FIG. 5(*a*). At a part "c" shown in FIG. 5(*a*), the width of the protection cover 14 is substantially equal to the spacing of the holder 9. Because of its shape, the protection cover 14 is fitted in the holder 9 without any gap. Moreover, as the protection cover 14 is supported by the holder 9 at a part "d" shown in FIG. 5(*b*), the protection cover 14 is prevented from being shifted by the opening/closing operation of the movable contact 5.

Even if the fitting parts of the protrusions 14*a* with the through-hole 5*a* and the fitting part of the recess portion 14*b* with the protrusion 5*b* are broken, the protection cover 14 is fixed at the parts "c" and "d" and prevented from falling off the movable contact 5.

According to the circuit breaker of this embodiment as described above, the protection cover 14 is made of an insulating material only and can be incorporated with the movable contact 5 without using any metal member such as a pin as in the conventional technique. Therefore, the pin clamping step, which is necessary in the conventional technique, can be eliminated and the manufacturing cost can be reduced accordingly.

Since no metal member is used in the structure related to the protection cover 14 and its incorporation with the movable contact 5, the spread of an arc, which is caused by the use of a metal material as in the conventional technique, can be prevented and the current limiting capability can be thus improved.

Moreover, in the case of incorporating the protection cover 14 with the movable contact 5, the sets of the recess portions and the protrusions to fit with each other are provided at the separate positions and the recess and protrusion of each set are fitted with each other. Accordingly, the protection cover 14 is prevented from shifting vertically or horizontally from the movable contact 5. Furthermore, since the protection cover 14 is so shaped that the periphery of its proximal end is supported by the holder 9, which rotatably supports the movable contact 5 on the circuit breaker case, shift or detachment of the protection cover 14 due to the opening/closing operation of the movable contact 5 is prevented.

Even when the fitting parts of the recesses and protrusions are broken, since the protection cover 14 is supported by the parallel inner walls and bottom side of the holder 9, the protection cover 14 is prevented from being detached by the opening/closing operation of the movable contact 5.

As these enable proper extinction of the contacts arc, damage to the wiring on the secondary side of the circuit breaker and the connection device can be prevented.

The disclosure of Japanese Patent Application No. 2004-172585, filed on Jun. 10, 2004, is incorporated in the application.

While the invention has been explained with reference to the specific embodiments of the invention, the explanation is illustrative and the invention is limited only by the appended claims.

What is claimed is:

1. A circuit breaker comprising:

a movable contact with an elongate shape having a contact at one end for flowing a current therethrough, and the other end rotatably supported with a holder, said movable contact having, near said one end, a recess or protrusion projecting laterally outwardly therefrom, and a protection cover made of only an insulating material for protecting the movable contact from short circuit and discharge, said protection cover having a shape for covering the movable contact and elasticity for tightly holding the movable contact, said protection cover including a pair of side walls for covering side portions of the movable contact, a protrusion or a recess portion formed in the side wall for engaging the recess or protrusion of the movable contact, an elongated recess portion formed in a middle of the side wall to extend upwardly from a lower end thereof, and a first bridging portion connecting the lower ends of the side walls near the elongated recess portion.

2. A circuit breaker according to claim 1, wherein said recess includes a through-hole penetrating two lateral sides of the movable contact or a recess portion provided in each of the two lateral sides, said protrusion of the protection cover fitting the through-hole or the recess portion of the movable contact.

3. A circuit breaker according to claim 1, further comprising a second bridging portion spaced from the first bridging portion.

4. A circuit breaker according to claim 2, wherein said movable contact further includes a projection at a middle thereof, said projection of the movable contact being situated in the elongated recess to support a middle area of the protection cover.

5. A circuit breaker according to claim 4, wherein said protection cover includes a space opening upwardly between the side walls so that the movable contact is inserted into the protection cover through the space for installation.

6. A circuit breaker comprising:

a movable contact with an elongate shape having a contact at one end for flowing a current therethrough, and the other end rotatably supported with a holder, said movable contact having recess portions near said one end, and a protection cover made of only an insulating material for protecting the movable contact from short circuit and discharge, said protection cover having a shape for covering the movable contact and elasticity for tightly holding the movable contact, said protection cover including a pair of side walls for covering side portions of the movable contact, protrusions protruding inwardly from the side walls for engaging the recess portions of the movable contact, elongated recess portions, each being formed in a middle of the side wall to extend upwardly from a lower end thereof, and a first bridging portion connecting the lower ends of the side walls near the elongated recess portion.

7. A circuit breaker according to claim 6, wherein said movable contact further includes projections at a middle thereof, said projections of the movable contact being situated in the elongated recesses to support a middle area of the protection cover.

* * * * *